United States Patent [19]

Symbol

[11] 3,936,228

[45] Feb. 3, 1976

[54] BOAT PROPELLER

[76] Inventor: Paul P. Symbol, 378 N. Slusser St., Grayslake, Ill.

[22] Filed: May 8, 1974

[21] Appl. No.: 467,866

[52] U.S. Cl. ..... 416/176; 416/200 R

[51] Int. Cl.[2] ..... B63H 1/14

[58] Field of Search ..... 416/176, 200, 177, 198, 416/201 A

[56] References Cited

UNITED STATES PATENTS

| | | | |
|---|---|---|---|
| 645,605 | 3/1900 | Pugsley | 416/200 |
| 847,961 | 3/1907 | De La Mar | 416/200 |
| 1,593,942 | 7/1926 | Lipari | 416/198 |
| 2,388,711 | 11/1945 | Sawyer | 416/176 X |
| 3,081,826 | 3/1963 | Loiseau | 416/242 X |

FOREIGN PATENTS OR APPLICATIONS

| | | | |
|---|---|---|---|
| 11,574 | 2/1928 | Australia | 416/176 |
| 977,987 | 4/1951 | France | 416/176 |
| 1,221,634 | 6/1960 | France | 416/176 |
| 20,187 | 6/1895 | United Kingdom | 416/176 |
| 56,009 | 9/1911 | Switzerland | 416/176 |

*Primary Examiner*—Everette A. Powell, Jr.

[57] ABSTRACT

A boat propeller includes an elongated shaft and three vanes which extend outwardly from the shaft at axially spaced positions there along. The vanes lie approximately along a helix on the shaft, and the vanes are spaced about 120° apart around the circumference of the shaft.

8 Claims, 3 Drawing Figures

3
3

BOAT PROPELLER

BACKGROUND AND SUMMARY

This invention relates to a propeller for a boat, and, more particularly, to a propeller which eliminates cavitation and provides continuous propulsion.

Many boat propellers suffer from one or more disadvantages. For example, some propellers cause cavitation, some do not provide positive propulsion at all times, and some become relatively easily fouled by weeds and other obstructions.

Propellers formed in accordance with the invention eliminate these problems. The propeller includes a blade which is helically disposed around an elongated shaft, and the outer periphery of the blade undulates to form three vanes which are spaced about 120° apart around the circumference of the shaft. The blade merges with the shaft between the vanes and in effect disappears so that the propeller can rid itself of weeds or other obstructions. The blades are spaced axially along the shaft and provide continuous, positive propulsion at all times and eliminate the problem of churning in one spot that is inherent in some propellers. The shape of the propeller also eliminates cavitation.

DESCRIPTION OF THE DRAWING

The invention will be explained in conjunction with an illustrative embodiment shown in the accompanying drawing, in which.

DESCRIPTION OF SPECIFIC EMBODIMENT

Figures 1, 2, 3:
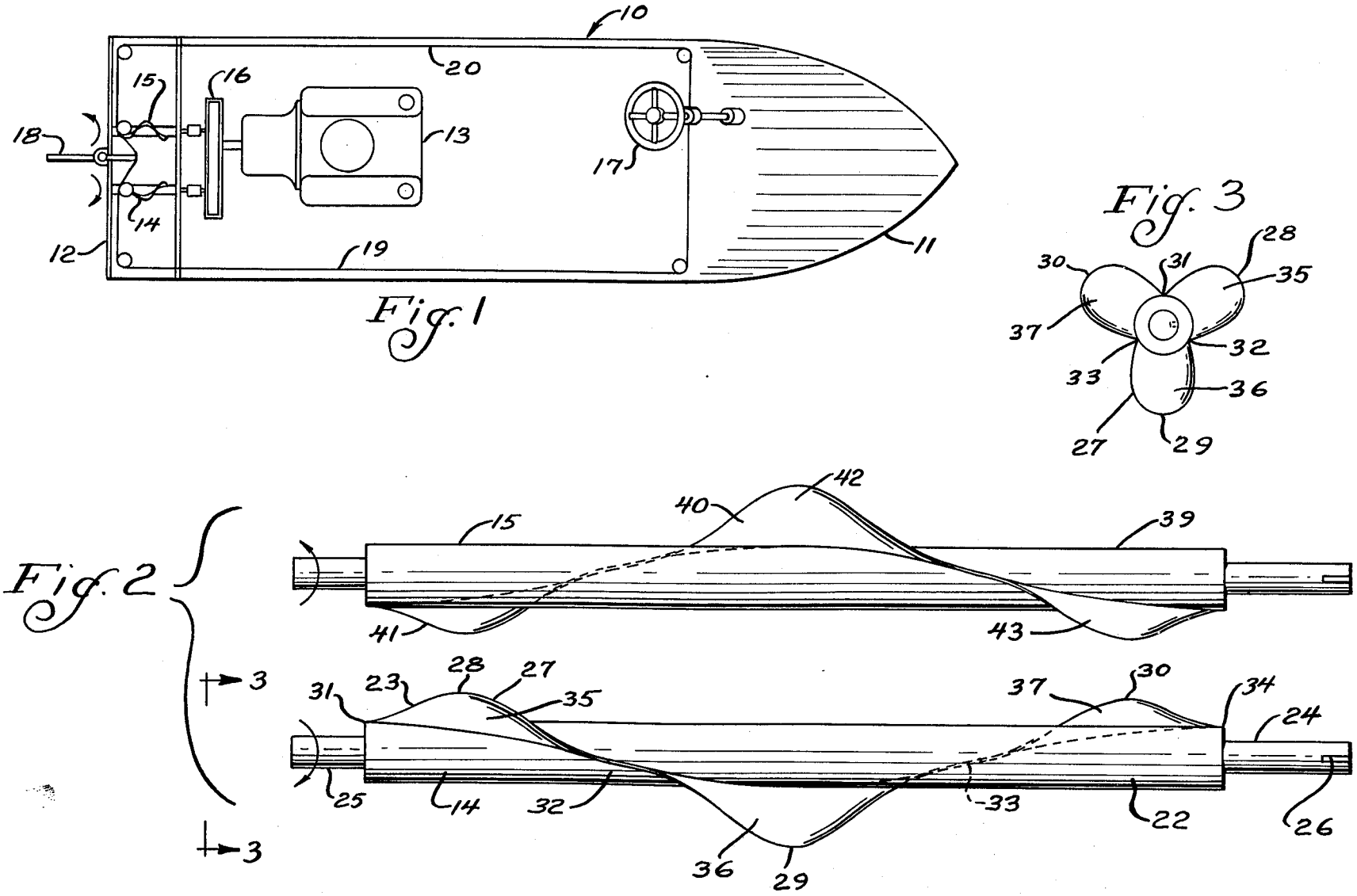
FIG. 1 is a top plan view of a boat equipped with a pair of propellers formed in accordance with the invention.
FIG. 2 is a top plan view of the two propellers of FIG. 1.
FIG. 3 is an end view of one of the propellers taken along the line 3—3 of FIG. 2.

Referring first to FIG. 1, the numeral 10 designates generally a boat having a bow 11 and a stern 12. A motor 13 drives a pair of propellers 14 and 15 through a conventional gear box 16, and a steering wheel 17 controls a rudder 18 by means of cables 19 and 20.

Referring now to FIG. 2, the propeller 14 includes an elongated cylindrical shaft 22 and a blade 23 which extends helically around the periphery of the shaft. The shaft includes a pair of reduced diameter bearing end portions 24 and 25, which are journaled in suitable bearings mounted on the keel of the boat. The bearing portion 24 is provided with a slot 26 to provide a driving connection between the propeller and the gear train.

The blade 23 follows a right hand helix and makes one complete revolution around the shaft from one bearing portion to the other. The outer periphery 27 of the blade undulates along a substantially sinusoidal curve as it follows the helix to provide three peaks 28, 29, and 30 and four low spots 31–34 which define three vanes 35, 36, and 37. The peaks 28–30 are spaced 120° apart around the circumference of the shaft (FIG. 3) and are equally spaced along the axial direction of the shaft. The low spots 31–34 of the outer periphery of the blade merge or substantially merge with the outer periphery of the shaft so that the blade disappears or substantially disappears at these points.

The propeller 15 similarly includes a shaft 39 and a blade 40 which provides three axially spaced vanes 41, 42, and 43. The propeller 15 is formed identically to the propeller 14 except that the blade 40 follows a left hand helix around the shaft 39.

The propellers are mounted in parallel positions below the keel of the boat so that the peaks of the vanes are slightly spaced as the propellers rotate. The gear train assembly 16 is constructed to rotate the propellers in opposite directions. In the illustration given, the boat is driven forward when the propellers are rotated in the direction of the arrows, the propeller 14 being rotated clockwise and the propeller 15 being rotated counter clockwise as viewed from the stern.

The propellers are arranged relative to each other so that the corresponding vanes on the propellers extend in generally opposite directions when the vanes are in the positions illustrated in FIG. 2. Thus, the peaks of the middle vanes 29 and 42 extend laterally outwardly from the propellers in diametrically opposed directions, or at about 3 o'clock and 9 o'clock, respectively, as viewed from the stern; the peaks of the first vanes 35 and 41 are positioned at about 11 o'clock and about 5 o'clock, respectively; and the peaks of the vanes 37 and 43 are positioned at about 7 o'clock and about 1 o'clock, respectively. This arrangement provides continuous thrust or propulsion as the propellers rotate, and the problem of the propellers simply churning in one spot, as can happen with propellers whose blades are located at substantially the same axially position, and the problem of cavitation are avoided. Further, since the blades essentially disappear at the low spots, the propellers will rid themselves of weeds and other obstructions as they rotate.

In one specific embodiment of the invention, each shaft was 42 inches long between the bearing end portions, and the shaft had a diameter of about 4 inches. Each vane extended in the axial direction for 13 inches between the associated low spots of the blade, and the peaks of the vanes extended outwardly 3 inches from the surface of the shaft. The ratio of the axial and radial dimensions of each vane was therefore 4⅓ to 1. This ratio is preferably maintained within the range of about 4 to 1 to about 5 to 1.

While in the foregoing specification a detailed description of a specific embodiment of the invention was set forth for the purpose of illustration, it is to be understood that many of the details herein given may be varied considerably by those skilled in the art without departing from the spirit and scope of the invention.

I claim:

1. A boat propeller comprising an elongated shaft and three vanes extending outwardly from the surface of the shaft at axially spaced positions there along, the intersection of each vane with the shaft lying along a common helix extending around the shaft, each vane having a smoothly curved outer periphery which extends outwardly from the shaft to form an apex for the vane and then inwardly toward the shaft, the apex of each vane being spaced about 120° from the apex of each adjacent vane around the circumference of the shaft.

2. The structure of claim 1 in which the outer periphery of each vane merges smoothly with the outer periphery of the adjacent vane.

3. The structure of claim 1 in which the outer periphery of each vane merges smoothly with the surface of the shaft at axially spaced positions from the apex of the vane.

4. The structure of claim 1 in which the ratio of the axial dimension of each vane between the innermost points of the periphery of the vane to the radial dimension of the vane between the shaft and the apex of the vane is within the range of about 4 to 1 to about 5 to 1.

5. The structure of claim 1 in which the outer periphery of each vane curves sinusoidally.

6. The structure of claim 1 in which the vanes are provided by a blade which extends helically around the shaft for approximately one revolution from adjacent one end of the shaft to adjacent the other end of the shaft, the blade having an undulating outer periphery which substantially merges with the shaft between adjacent vanes.

7. A boat propeller comprising an elongated shaft and a single blade which extends helically around the shaft for approximately one revolution from adjacent one end of the shaft to adjacent the other end of the shaft, the blade having a smoothly curved, undulating outer periphery which extends outwardly and inwardly relative to the shaft to provide the blade with low spots near the shaft and apexes spaced outwardly from the shaft, the blade having three apexes, a low spot at each end of the shaft and a low spot between each pair of adjacent apexes, each low spot of the blade periphery substantially merging with the shaft, the apexes being spaced approximately 120° apart around the circumference of the shaft.

8. The structure of claim 7 in which each low spot of the blade periphery merges with the outer periphery of the shaft.

* * * * *